US007179018B2

(12) United States Patent
Hall et al.

(10) Patent No.: US 7,179,018 B2
(45) Date of Patent: Feb. 20, 2007

(54) APPARATUS AND METHOD FOR WORKING ASPHALT PAVEMENT

(76) Inventors: David R. Hall, 738 E. 2380 North, Provo, UT (US) 84606; Francis Leany, 2185 S. Larsen Pkwy., Provo, UT (US) 84606; Robert P. Chase, 2185 S. Larsen Pkwy., Provo, UT (US) 84606; Garret Smith, 2185 S. Larsen Pkwy., Provo, UT (US) 84606; Matthew Hellewell, 2185 S. Larsen Pkwy., Provo, UT (US) 84606; Joe Fox, 572 S. 1750 East, Spanish Fork, UT (US) 84660

( * ) Notice: Subject to any disclaimer, the term of this patent is extended or adjusted under 35 U.S.C. 154(b) by 172 days.

(21) Appl. No.: 11/010,706

(22) Filed: Dec. 13, 2004

(65) Prior Publication Data

US 2006/0127180 A1 Jun. 15, 2006

(51) Int. Cl.
*E21C 25/00* (2006.01)

(52) U.S. Cl. ..... 404/90; 404/94; 299/41.1; 175/15

(58) Field of Classification Search ..... 404/90, 404/91, 93, 94; 175/11, 15; 299/41.1
See application file for complete search history.

(56) References Cited

U.S. PATENT DOCUMENTS 3,217,620 A * 11/1965 Mindrum et al. ..... 404/90
3,557,419 A * 1/1971 Flannery ..... 407/36
3,934,659 A * 1/1976 Tsiferov ..... 175/14
4,190,121 A * 2/1980 Baum et al. ..... 175/14
4,317,642 A * 3/1982 Wirtgen ..... 404/72
4,453,775 A * 6/1984 Clemmow ..... 299/81.1
6,076,895 A * 6/2000 Ino et al. ..... 299/41.1
6,113,195 A * 9/2000 Mercier et al. ..... 299/104
6,149,342 A * 11/2000 Phillips ..... 404/90
6,161,625 A * 12/2000 Mati ..... 172/96
6,179,519 B1 * 1/2001 Hilmersson ..... 404/91
6,375,272 B1 * 4/2002 Ojanen ..... 299/111
6,508,516 B1 * 1/2003 Kammerer ..... 299/104
6,887,013 B2 * 5/2005 Ley et al. ..... 404/90

* cited by examiner

*Primary Examiner*—Gary S. Hartmann
(74) *Attorney, Agent, or Firm*—Daniel P. Nelson; Tyson J. Wilde

(57) ABSTRACT

A method and apparatus for working asphalt pavement, comprising one or both of a mechanical, hydraulic, electric, or pneumatic means for providing high-speed rotation; a rotary tool comprising a first end comprising a working surface and a second end adapted for connection to the means for providing high-speed rotation; and a screed, cooperatively arranged with the rotary tool, and comprising a working surface adjacent the working surface of the rotary tool, wherein the rotary tool is spun at high speed and applied to the asphalt pavement, frictionally heating the asphalt pavement to a temperature sufficient to work the pavement locally adjacent rotary tool and the screed. The screed and rotary tool comprising abrasion resistant materials selected from the group consisting of high-strength steel, hardened alloys, cemented metal carbide, polycrystalline diamond, and cubic boron nitride. The rotary tool and the screed apparatus may comprise a closed loop control system.

15 Claims, 11 Drawing Sheets

APPARATUS AND METHOD FOR WORKING ASPHALT PAVEMENT

RELATED APPLICATIONS

None

BACKGROUND OF THE INVENTION

This invention relates to an apparatus and method for working asphalt pavement. More specifically, this invention relates to a rotary tool that is spun at high speed and applied to the pavement, thereby locally heating the pavement to a temperature sufficient to work the pavement adjacent the rotary tool.

In this application, "asphalt pavement" refers to the compact, wear resistant surface that facilitates vehicular, pedestrian, or some other form of traffic, such as along roadways, streets, highways, freeways, shoulders, raceways, parkways, trails, pathways, runways, tarmacs, parking lots, ramps, driveways, alleyways, sidewalks, and crossings.

The asphalt pavement may comprise some or all of oil, tar, tarmac, macadam, tarmacadam, asphalt, asphaltum, pitch, bitumen, minerals, rocks, pebbles, gravel, sand, polyester fibers, and petrochemical binders. The asphalt composition is usually heated, laid down, compacted, and finished to provide a paved, traffic-worthy surface.

Once the asphalt pavement is in place, it remains in a plastic state, and its wear resistance is affected by ambient conditions such as heat and moisture, erosion, and traffic usage. High ambient temperatures may cause the otherwise hard surface to soften, expand, and plastically deform under the weight of heavy-weight vehicular traffic. Therefore, it is not unusual to find depressions and ruts in asphalt paved surfaces resulting from the passage of the heavy-weight vehicles on a hot day. Low ambient temperatures cause the asphalt pavement to contract and crack. Under freeze thaw conditions, the expansion and contraction of the pavement causes the aggregate components in the asphalt pavement to separate, resulting in surface wear. Moisture trapped beneath the asphalt pavement or seeping up through the pavement also may contribute to the deterioration of the paved surface.

The effects of weather, moisture, and high traffic combine to wear away the asphalt pavement. Wear usually manifests itself in the form of loosened asphalt materials on the surface of the pavement, surface and subsurface cracks and voids, and pot holes.

In traffic areas repairs and maintenance of paved surfaces is an ongoing process that is somewhat problematic. First of all, the mere presence of labor, materials, and equipment in traffic areas is hazardous. Secondly, because of its chemistry, used asphalt pavement is classified as a hazardous material and is difficult to dispose of. Therefore, it is preferred to recycle used asphalt pavement, but this requires expensive and complex systems for removing the pavement from the roadbed, transporting the asphalt to a recycling area, grinding up the asphalt and reconditioning it suitable for reuse; and then transporting to where it will be reapplied.

Another difficulty in repairing and maintaining asphalt pavements is the presence of utility easements and boxes, manholes and manhole covers, culverts, rails, curbs, gutters, and other non-asphalt obstacles that are found in modern road ways. Negotiating around these man-made obstacles is time consuming, labor intensive, and also dangerous.

Maintenance and repair of asphalt pavement may comprise a multi-step process including heating the paved surface; mechanically decomposing or breaking up the asphalt surface; applying reconditioning materials to the decomposed asphalt; reapplying the reconditioned asphalt to the road surface; and compacting and finishing the asphalt surface to the desired specifications.

Numerous systems have been proposed to accomplish each step in the maintenance and repair process for asphalt pavement. The following patents are exemplary of such systems.

U.S. Pat. No. 3,970,404, to Benedetti, teaches a method for the reconstruction of asphalt pavement. The method includes heating the pavement in successive stages so that it may be heated to a working temperature without overheating that would lead to deterioration of the asphalt properties.

U.S. Pat. No. 4,018,540, to Jackson, Sr., discloses a road maintenance machine with a heater assembly mounted on a general purpose chassis. The heater includes multiple burners, exhaust hoods, and heat shields in order to direct the generated heat and gases onto the pavement. The chassis is provided with additional hydraulic equipment to assist the road maintenance process such as adjustable planer and scarifier to work the heated asphalt. An elevator is provided at the rear of the machine to remove the asphalt debris from the roadway.

U.S. Pat. No. 4,104,736, to Mendenhall, teaches an improved asphalt-aggregate recycling process by direct exposure of the asphalt to hot gases of combustion to form a gaseous exhaust mixture, and subjecting the gas mixture to a centrifugal force sufficient to separate out the hydrocarbon particulates for recycling.

U.S. Pat. No. 4,335,975, to Schoelkopf, discloses a method for resurfacing roads whereby the road surface is first plastified and broken-up by first and second separable devices. The broken-up material is immediately distributed, rearranged, and contoured onto the road surface by the second device without the introduction of fresh asphalt or bituminous material. A repaver apparatus forming a third separate device then applies fresh asphalt or bituminous material onto the broken-up, rearranged material. Preferably, two distributions of broken-up material are employed prior to the asphalt application and compaction of the new asphalt material.

U.S. Pat. No. 4,407,605, to Wirtgen, describes, inter alia, an apparatus comprising a chassis including its own drive engine and at least one heating device and means for loosening the road coating arranged behind it. The means for loosening the road coating is a small roller provided with chisels and rotating in the direction opposite the direction the chassis is going. The roller is arranged in a discharge area of a container holding new coating material such that when rotating, the roller compounds old material with new material.

U.S. Pat. No. 4,601,605, to Damp et al., teaches a scarifier for use with an asphalt roadway surface. The scarifier features a number of heaters of the luminous wall type in order to direct large quantities of radiant heat downwardly towards the surface for softening of it while traveling along the roadway. These heaters consist basically of porous fire bricks through which an air/propane mixture passes and on the surface of which it burns. Each heater also has porous side walls that project closer to the roadway surface than the main bricks and are supplied with air for forming a downward curtain of air to inhibit sideways escape of heat from the region beneath the heater. The heaters are assembled in banks that are spaced apart from each other in the direction of travel. This spacing can be adjusted. Each pair of adjacent banks is bridged by heat deflectors that help to provide heat soak areas between the heater banks.

U.S. Pat. No. 4,594,022, to Jeppson, provides for a microwave energy reflecting zone below the surface of pavement. The reflecting zone is established within the range that microwave energy can penetrate. The reflective zone, which is formed of electrically conductive material, results in energy and cost savings in subsequent paving or pavement repair operations that involve microwave heating of thermoplastic pavement. The heating is concentrated in within the localized upper portion of the pavement. Different microwave heating patterns may be employed.

U.S. Pat. No. 4,619,550, to Jeppson, teaches a method for economically heating fragmented old aspahltic concrete by temporarily separating larger pieces from the smaller fragments, generating heat internally within the large pieces with penetrating microwave energy, separately heating the smaller fragments by exposure to hot gas, and then recombining and remixing the separately heated components.

U.S. Pat. No. 4,793,730, to Butch, reveals a method and apparatus for renewing the surface of asphaltic paving at low cost and for immediate reuse. The asphalt surface is heated to about 300° to 500° F. The surface is broken to a depth of about two inches and the lower material thoroughly mixed in situ with the broken surface material. After mixing the material is further heated to fuse the heated mixture into a homogeneous surface. The surface is screed for leveling and compacted by a road roller. The process features a steam manifold for heating the asphalt, transversely reciprocating breaker bars having teeth adjusted to the desired depth, and a second steam manifold for reheating the mixed material.

U.S. Pat. No. 5,366,320, to Hanlon et al., discloses an improved screed for leveling abrasive paving material on a road surface. The screed is highly abrasion resistant and loses much less heat during shutdown periods than a steel screed because it is formed of a composite that includes a chromium-carbide alloy. The alloy has a Brinell hardness in the range of 550 to 600 and a low coefficient of friction. The screed features a curved leading edge to prevent asphalt material from welling up over the front of the screed as it travels along the surface of the asphalt pavement.

U.S. Pat. No. 5,556,225, to Marino, provides for a method of immediately repairing multiple backfilled utility cut trenches, potholes, and other discontinuities in asphalt pavement, at any ambient temperature, in which the pavement discontinuity is bridged by layers of heated virgin bituminous concretes of different grades, each layer including aggregate stone mixed with liquid asphalt binder. Alternatively, substantially non-polymerized thermoplastic bituminous concretes of different grades may be used to form the bridging layers, each layer including aggregate stone mixed with a liquid asphalt binder and preferably also containing fractions of n-pentane soluble asphalts and being repetitively softenable in response to repetitive applications of infrared radiation.

U.S. Pat. No. 6,371,689, to Wiley, teaches a method and apparatus for heating an asphalt-paved road surface by forcing gases heated by a heater against the road surface and then returning those gases to the heater for reheating and recirculation, wherein the temperature of the returning gases is measured by a temperature sensor, and the heater is automatically adjusted to that the temperature of the gases is automatically decreased as the temperature of the returning gases increases. This prevents damage to the asphalt and premature rupturing of the road surface.

It is known that some materials may be worked by friction heating, for example friction welding. Rotary friction welding was the first of the friction processes to be developed and used commercially to join work pieces together. The simplest mechanical arrangement for continuous-drive rotary friction welding involves two work pieces being brought into axial alignment. One of the pieces is rotated while the other is advanced into contact under a known axial pressure. Rotational contact continues for a time sufficient for the temperature to plasticize the metal interface in the region of the joint. Having achieved this condition, the rotating work piece is stopped while the pressure is either maintained or increased to consolidate the joint.

Another method of friction welding is known as inertia welding. Inertia welding differs from rotary welding in that the rotating work piece is attached to a flywheel which is accelerated to a known rpm. The flywheel is then disconnected from its driving mechanism. The spinning flywheel is then brought into contact with the stationary work piece in such a manner that the frictional braking action produces the required heat for welding.

U.S. Pat. No. 6,732,900, to Hansen et al., describes a process known as friction stir welding. The process involves welding component parts together using friction heat generated at the welding joint to form a plasticized region that solidifies to join work piece sections. Welding is performed by inserting a probe into a joint between the work piece sections. The probe includes a pin that is inserted into the joint and shoulder, which is urged against the surfaces of the work pieces. The pin and shoulder spin together to generate friction heat to form the plasticized region along the joint for the welding operation. Hansen further discloses a friction stir welding spindle with an axially displaceable shaft.

U.S. Pat. No. 6,779,704, to Nelson et al., teaches a process for frictional stir welding metal matrix composites, ferrous alloys, non-ferrous alloys, and super alloys using superabrasive materials.

The applicants were surprised to discover that aggregate asphalt pavement may be worked, i.e. heated and decomposed, using a frictional rotary tool in place of the conventional heating and mechanical decomposition systems of the past.

SUMMARY OF THE INVENTION

This invention discloses a method and apparatus for working asphalt pavement using frictional energy provided by a rotary tool. The invention comprises one or both of a mechanical, hydraulic, electric, or pneumatic means for providing high-speed rotation to the rotary tool. The rotary tool comprises a first end comprising a working surface of abrasion resistant material and a second end adapted for connection to the means for providing high-speed rotation. A screed may be cooperatively arranged with the rotary tool, and the screed may act in conjunction with the rotary tool or independently of it. The screed comprises a working surface adapted for low friction and high wear. The screed may be disposed adjacent the working surface of the rotary tool and may control the depth to which the rotary tool is applied to the asphalt pavement. When the rotary tool is spun at high speed and applied to the asphalt pavement, the rotary tool frictionally heats the pavement to a temperature sufficient to work the pavement locally adjacent the rotary tool, and also the screed. The screed may contain the decomposed asphalt pavement and may also act to re-compact the pavement.

The screed and the rotary tool may comprise abrasion resistant materials selected from the group consisting of high-strength steel, hardened alloys, cemented metal carbide, polycrystalline diamond, and cubic boron nitride. At least a portion of the working surface of screed and the rotary tool comprising these abrasion resistant materials may be finished to a mirror-like polish.

The rotary tool and the screed may be provided with passageways and nozzles for adding renewal materials such as sand, gravel, tar, tarmacadam, pitch, asphalt, bitumen, minerals, polyester fibers, petrochemical binders, and oil to the asphalt pavement being worked by the rotary tool and the screed. The renewal materials may also be provided before the asphalt pavement is worked by the rotary tool.

The rotary tool and screed may comprise bearing mechanisms for allowing vertical, horizontal, angular, and precessional displacement of the rotary tool in order to promote efficient working of the asphalt pavement. Such mechanisms include roller bearings, ball bearings, needle bearings, and thrust bearings, or combinations thereof.

To further optimize the working of the asphalt pavement, the rotary tool and the screed may be in communication with a closed loop control system comprising computers, PLC systems, electromechanical systems, various sensors and linear measurement devices, and look ahead systems comprising direct contact, sonic, acoustic, infra red, nuclear resonance imaging, and magnetic resonance imaging to identify regions where hazards may exist and repairs may be required. The system may also identify conditions such as hazards; depressions; and variations in the pavement, such as cracks, pot holes, manhole covers, rails, and other obstacles. The closed loop system may control the application of the rotary tool and the screed to the pavement in anticipation of these conditions and obstacles, especially those that may be detrimental to the rotary tool. The closed loop system may avoid hazardous conditions by controlling the working depth of the rotary tool and screed, the load on the rotary tool and the screed, the angle of attack of the rotary tool and the screed when applied to the asphalt pavement, the rotary tool's speed of rotation, i.e. revolutions per minute or rpm, the addition of renewal materials, and the working temperature of the asphalt. Along paved surfaces where defects are sporadic, the closed loop control system may selectively apply the rotary tool and the screed only to regions and to depths of the asphalt pavement where repairs are required.

DETAILED DESCRIPTION OF THE INVENTION

The invention will be further described in relation to the following discussion and figures.

This invention comprises a rotary tool for working asphalt pavement attached to a means for providing high-speed rotation and thrust. The rotary tool comprises a first end comprising a working surface and second end adapted for connection to the means for providing high-speed rotation and thrust. In operation, the rotary tool is rotated at high speed and applied to a selection of asphalt pavement. The working surface of the tool frictionally heats the asphalt to a temperature, say to about between 200° to 400° F., sufficient to soften the asphalt binder. The rotary action of the tool then disintegrates the asphalt composite materials and prepares them for reconsolidation into a renewed surface, thereby working the asphalt. In this manner cracks and fissures in the asphalt may be healed. The asphalt pavement surface may be pre-heated before being decomposed by the rotary tool.

Figure 1:
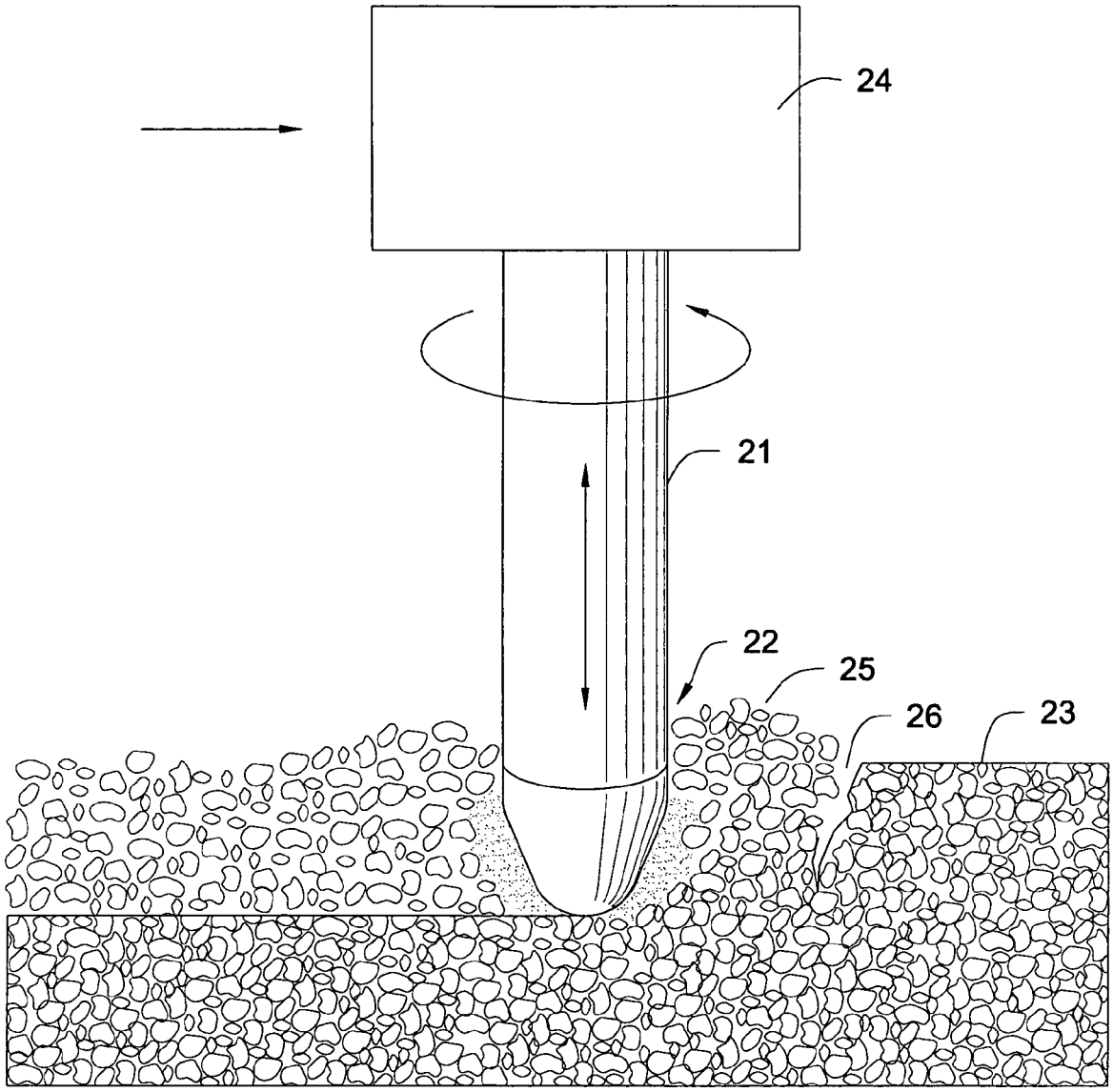
FIG. 1 is a diagram of an embodiment of a rotary tool of the present invention.

FIG. 1 is a diagram of an apparatus for working asphalt pavement 23 and may comprise a shaft 21 that may be movably attached to a means for providing high-speed rotation and thrust 24. The means for providing rotation and thrust 24 may comprise a mechanical, electrical, or hydraulic mechanism, or a combination thereof, for providing rotation, torque, and thrust to the shaft 21. The shaft 21 may comprise a means for attachment to the means for providing rotation and thrust 24 and a working surface 22 that may comprise at least in part a surface coated with a heat tolerant, wear resistant material such as a ceramic, steel, a ceramic steel composite, a steel alloy, a bronze alloy, or a super-material such as a pre-cemented metal carbide, such as tungsten carbide; synthetic diamond by the high-temperature high-pressure method or by the chemical vapor deposition method, or a combination thereof, or cubic boron nitride.

The method disclosed herein may comprise rotating the shaft 21 at a high rate of speed, say about between 750 and 3000 rpm, and applying the spinning shaft 21 against an asphalt paved surface 23 in the vicinity of a fissure or crack 26 in the asphalt pavement 25 with sufficient thrust that the friction created produces localized heat, about between 200° and 400° F., sufficient to breakdown the chemical bonds between the asphalt constituents, thereby working the asphalt 25 to a desired depth suitable for eliminating the fissures and cracks 26 in the vicinity of the traveling tool upon reconsolidation of the pavement. The means for providing high-speed rotation and thrust 24 and the shaft 21 may cooperate to change the depth at which the rotating shaft 21 penetrates the asphalt. The friction produced at the working surface 22 heats the asphalt locally around the working surface 22 of shaft 21, first disintegrating the asphalt 25 and then preparing the asphalt 25 for reconsolidation into a renewed paved surface.

Figure 2:
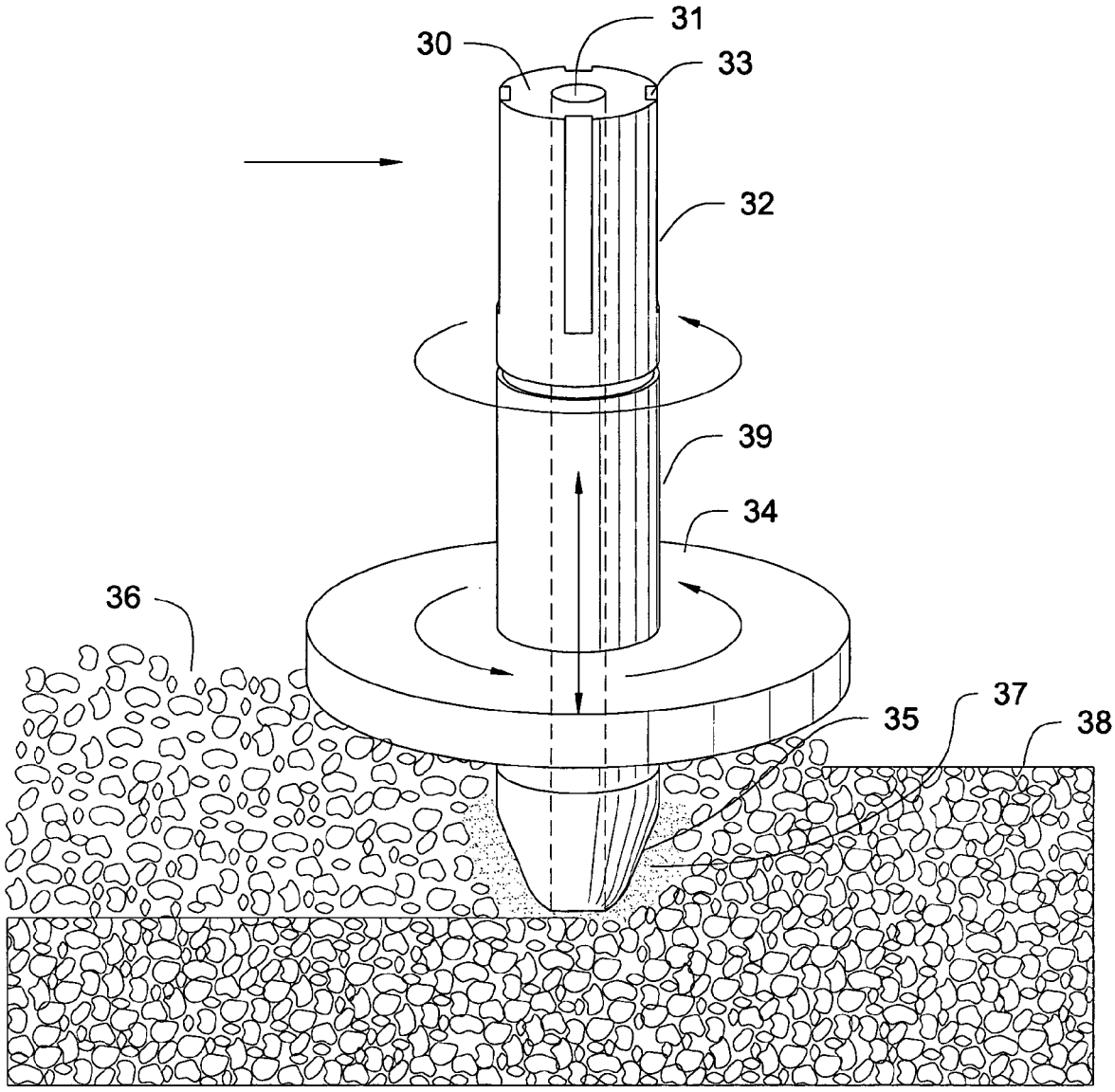
FIG. 2 is another diagram of a rotary tool of the present invention.

FIG. 2 is a diagram of an embodiment of a high-speed rotary tool 32 of the present invention shown working portions of compacted asphalt pavement 38 into decomposed asphalt pavement 36. The high-speed rotary work of tool 32 may frictionally heat the pavement sufficiently to thermally soften the asphalt binder and then further decompose the pavement 36 by the rotary action of the tool.

The rotary tool 32 comprises a shank 39, comprising a high-strength steel such as EN30B, obtainable from Finkl Forge, Chicago, Ill., intermediate a working surface 35, adapted to penetrate and work asphalt pavement 38, and an end 30 comprising a means for connection 33 to a means for rotating tool 32, as shown in FIG. 1. Although the means for rotating rotary tool 32 is not shown, it may comprise a mechanical, electrical, or hydraulic means, such as a combustion engine, an electric motor, or a hydraulic motor, or a combination thereof, connected directly or indirectly, by means of a combination of gears and levers, or a rotary power hydraulic transmission system, to the rotary tool 32.

The rotary tool 32 may comprise a collar 34 positioned above the working surface 35 to contain the decomposed asphalt pavement 36. The collar 34 may rotate with the tool 32 or it may move independent of tool 32. The collar 34 may also control the depth to which the working surface 35 is allowed to penetrate the asphalt pavement 38. Further, while the decomposed asphalt remains at a working temperature, the collar 34 may also cooperate with the rotary tool 32 as a screed to smooth and compact the decomposed asphalt pavement 36 into a renewed surface. In selected applications, the rotary tool may only be applied in selected regions of asphalt pavement where fissures and cracks are manifest.

The rotary tool 32 may further comprise a passageway 31 running along the vertical axis of the tool connecting an opening in end 30 with an opening adjacent the working surface 35. The passageway 31 may be connected to a remote supply of asphalt pavement renewal materials, not shown, selected from the group consisting of asphalts, petrochemical binders, oils, tars, asphaltums, macadams, tarmacadams, tarmac, pitches, bitumens, minerals, rocks, pebbles, gravels, sands, and combinations thereof. These renewal materials may be added to the asphalt pavement as the rotary tool 32 works the pavement.

The working surface 35 may affect a zone 37 adjacent the working surface. The affected Zone may comprise primarily softened and melted asphalt binder, such as bitumen. The affected zone of asphalt 37 may be renewed with additional amounts of renewal materials that are forced through the axial passageway 31. In this manner, existing pavement surfaces may be renewed in their wear properties.

The rotary tool 32 may be mounted in a frame or chassis, not shown, and adapted for vertical displacement as shown by the arrows, in order to work the asphalt pavement at different elevations according to the surface and sub-surface conditions of the pavement and other requirements for asphalt pavement remediation.

Figure 3:
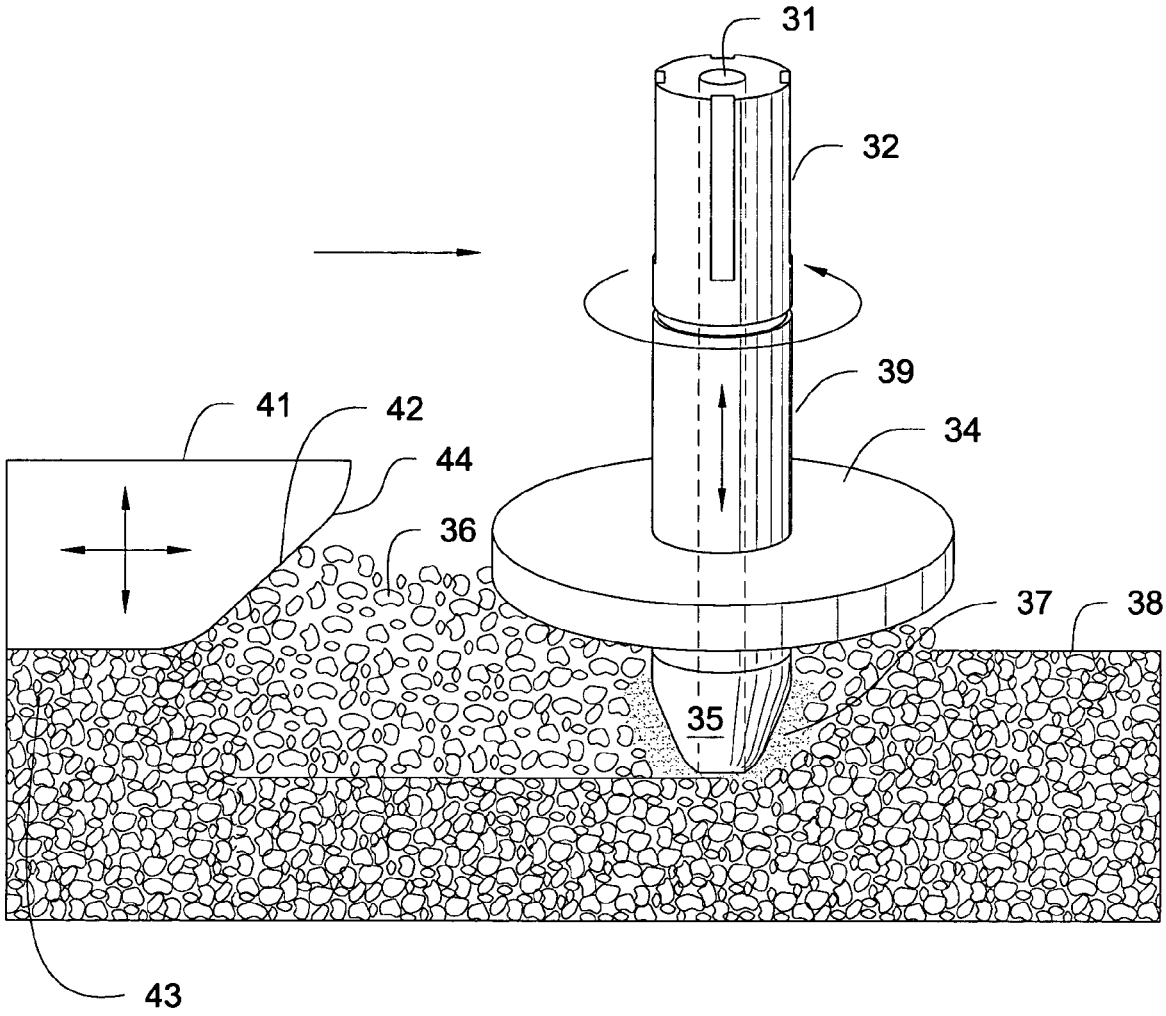
FIG. 3 is a diagram of a rotary tool of the present invention being used in cooperation with a screed apparatus.

FIG. 3 is a diagram of the rotary tool 32 as shown in FIG. 2 working in cooperation with a screed mechanism 41 comprising a working surface 42. The working surface 42 of the screed 41 may be smooth and flat with an inclined portion nearest the tool 32 along its leading edge 44. The inclined portion 44 may enhance the screed's ability to pass over the worked asphalt 36. It may be desirable for the working surface of the screed 41 to be slightly concave in the direction normal to the screed's travel, or normal to the screed's inclined leading surface 44, in order for the screed's working surface 42 to contain the worked pavement 36 as it is being recompacted. At least a portion of the working surface 42 of the screed mechanism may comprise a mirror-like polished finish. The screed mechanism may comprise mild steel, metal carbide, high-hardness steel alloy, or a combination thereof. Materials having hardness in the range of 550 to 600 on the Brinell hardness scale may be preferred. The screed 41 may comprise a material that has low thermal conductivity so as not to draw heat away from the worked asphalt 36 before it may be recompacted into a renewed paved surface 43. The working surface 42 of the screed 41 may comprise high hardness materials such as chromium carbide, niobium carbide, tungsten carbide, and titanium carbide, or a nickel-chromium alloy that are not reactive with the asphalt pavement, offer high wear resistance, and are poor conductors of thermal energy. The screed 41 may provide a means for leveling and compacting hot asphalt material 36 that has been worked by the rotary tool 32. The softened and disintegrated asphalt material 36 may be initially compacted as the screed 41 passes over the worked asphalt material 36 with a compressive thrust. A sufficient load on the screed 41 may provide enough compaction to finish the asphalt paved surface 43. The screed 41 may be mounted on a frame adjacent rotary tool 32 and may cooperate with tool 32 in establishing the final grade of the paved surface 43.

Figure 4:
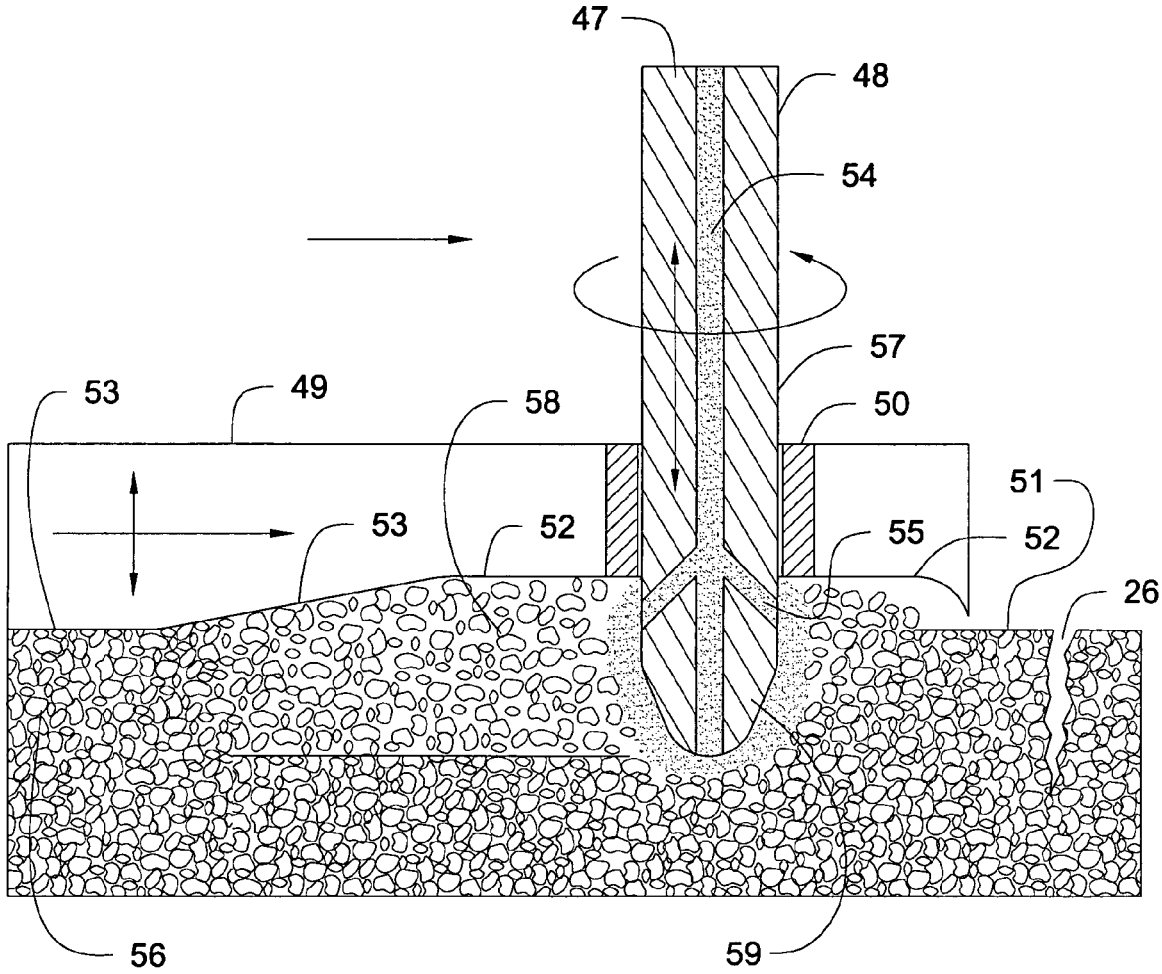
FIG. 4 is a diagram of a rotary tool comprising multiple passageways disposed within a screed apparatus of the present invention.

FIG. 4 is a diagram of an embodiment of a rotary tool 48 assembly apparatus working an asphalt paved surface 51 in cooperation with an integral screed mechanism 49. As depicted in FIG. 1, the rotary tool 48 may be attached to a means for providing high-speed rotation, though not shown in FIG. 4. The asphalt paved surface may have one or more fissures, cracks, or crevices 26, or other discontinuities 26, that require remediation by means of rotary tool 48. The rotary tool 48 may be applied to the asphalt pavements locally in the vicinity of discontinuities 26 to renew, or remediate, the asphalt pavement locally, or rotary tool 48 may be applied broadly to an entire section of pavement where a more thorough renewal of the pavement is desired. Both the rotary tool 48 and the screed mechanism 49 may move, as indicated by the arrows, vertically and horizontally, independently of one another or they may cooperate in unison, in order to accommodate pavement surface irregularities and elevations 26 and to achieve desired contours for the finished paved surface 56.

The rotary tool 48, as depicted in FIG. 4, comprises working surface 59 and an end 47 adapted for attachment to a means for providing high-speed rotation as shown in FIG. 1. The tool 48 may comprise one or more internal passageways. The tool 48 further comprises an axial passageway 54 and radial, and near radial passageways 55, connecting at least a portion of the working surface of rotary tool 48 a remote source of asphalt pavement renewal materials. The passageways 54 and 55 may be communication with remote sources of asphalt renewal materials and may provide a means for adding asphalt renewal materials to the decomposed, or disintegrated, paved surface 58 being worked by rotary tool 48. The renewal materials may be selected from the group consisting of asphalts, petrochemical binders, oils, tars, asphaltums, macadams, tarmacadams, tarmac, pitches, bitumens, minerals, rocks, pebbles, gravels, and sands, and combinations thereof.

The renewal materials may be conducted through the passageways 54 and 55 and may be mixed, and thoroughly mixed, with the decomposed asphalt 58. The mixing may be aided by the heat energy created at the working surface 59 as the tool 48 is spun at high speed and applied to a pre-determined depth against the asphalt pavement 51 in order to remediate discontinuity 26. The flow of the renewal materials through the passageways 54 and 55 may assist in regulating the temperature of the working surface 59 of the rotary tool 48.

The working surface 52 and 53 of the screed 49 may present a concave surface in order to cooperate with the rotary tool 48 to contain the decomposed asphalt pavement 58 and contour the recompacted asphalt pavement 56 of the finished paved surface. Working surface 53 may cooperate with working surface 52 to recompact the decomposed and renewed asphalt pavement 58.

A bearing 50 apparatus may be disposed adjacent a polished wear surface 57 of the rotary tool 48. The polished wear surface 57 may comprise a material having high hardness selected from the group consisting of nickel, chrome, chromium carbide, niobium carbide, tungsten carbide, and titanium carbide, or a nickel-chromium alloy, and a combination thereof. The bearing apparatus 50 may comprise one or more bushings and bearings selected from the group consisting of bushings, roller bearings, ball bearings, needle bearings, sleeve bearings, thrust bearings, linear bearings, and tapered bearings, or combinations thereof. The bearing apparatus 50 may facilitate vertical and horizontal displacement of the rotary tool 48.

Figure 5:
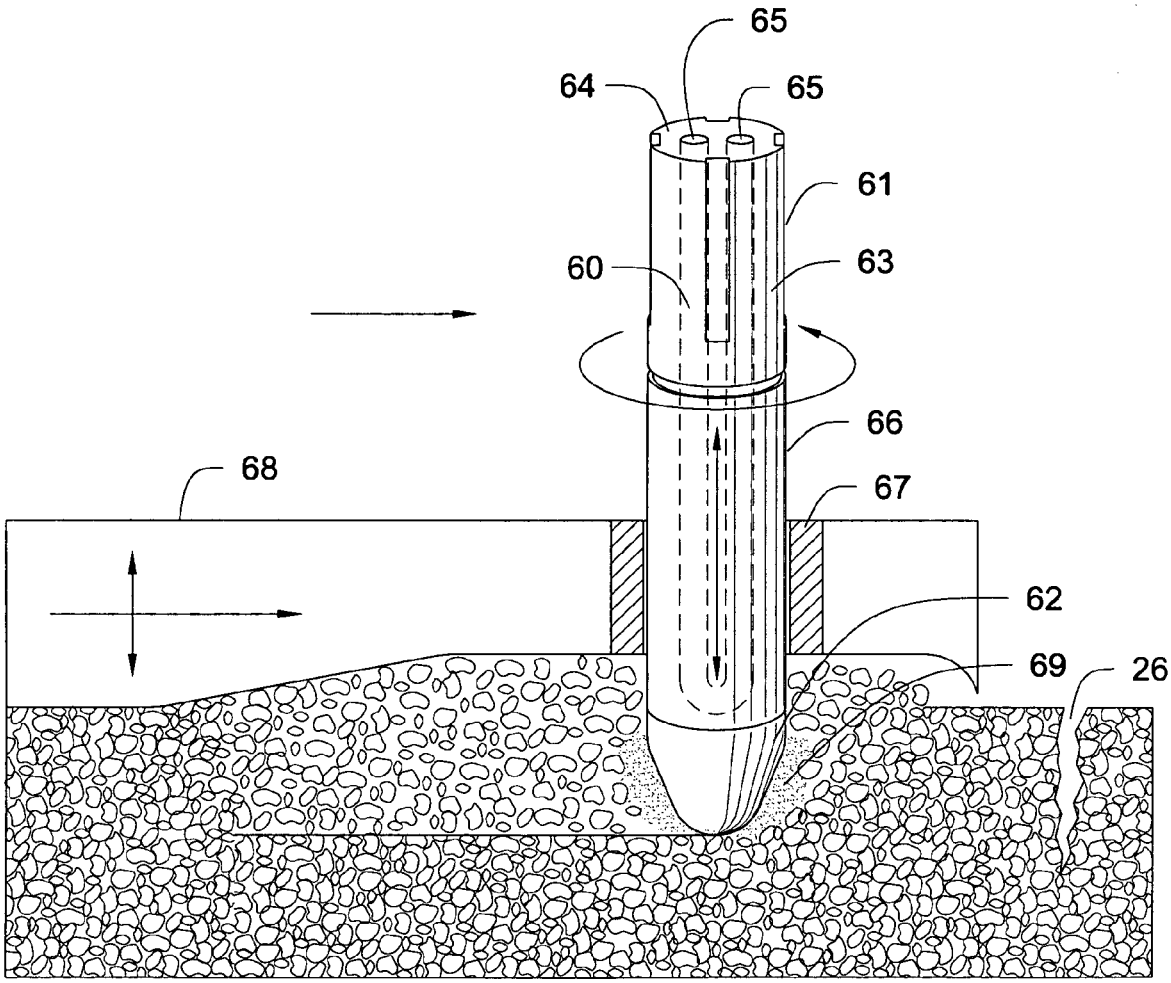
FIG. 5 is a diagram of a rotary tool comprising a continuous passageway for active cooling.

FIG. 5. is a diagram of an embodiment of the present invention comprising a screed apparatus 68, similar to the screed 49 depicted in FIG. 4. The screed 68 comprises a bearing apparatus adjacent a wear surface 66 of a rotary tool 61, also similar to the rotary tool depicted in FIG. 4. The rotary tool 61 comprises a working surface 62 and an end 64 comprising a means for connection 63 to a means for providing high-speed rotation, similar to that 24 shown in FIG. 1. The end 64 may comprise openings 65 and passageway 60, which form a continuous loop through rotary tool 63. Openings 65 and passageway 60 may be in addition to passageway 31, of FIG. 3, or in addition to passageways 54 and 55, of FIG. 4. The openings 65 and passageway 60 may be in communication with a remote source of fluids suitable for cooling and regulating the temperature of rotary tool 61. Fluid flowing through the continuous passageway 60 may be used to carry off heat generated by rotary tool 61 as it works asphalt pavement in the vicinity of surface discontinuities such as 26.

Rotary tools of the present invention may be useful in working asphalt pavements selected from the group consisting of roadways, streets, highways, freeways, shoulders, raceways, pathways, trails, runways, tarmacs, parking lots, driveways, lanes, tracks, sidewalks, and crossings. The rotary tools of the present invention may be used singly or ganged in an array suitable for entire paved sections. In any case, the rpm, trajectory, and depth of the tools may be controlled by such devices as computers, PLC systems, and other motion control logic systems as required to by the asphalt surface being remediated.

As the temperature of the working surface 62 increases, a temperature related affected zone 62 forms adjacent the working surface 62 of the rotary tool 61. The affected zone comprises mostly softened or melted asphalt. Regulating the temperature of the affected zone 62 is important in order to prevent the chemical breakdown of the asphalt binder in the asphalt pavement. The screed 68 may provide insulation to help maintain the temperature of the worked asphalt so that renewal materials may be added and thoroughly mixed into the asphalt matrix before the asphalt is recompacted into a remediated pavement surface. Asphalt renewal materials being added to the affected zone may also help control the temperature in the vicinity of the rotary tool and preserve the integrity of the asphalt binder materials as well as the working surface 62 of the rotary tool 61.

Figure 6:
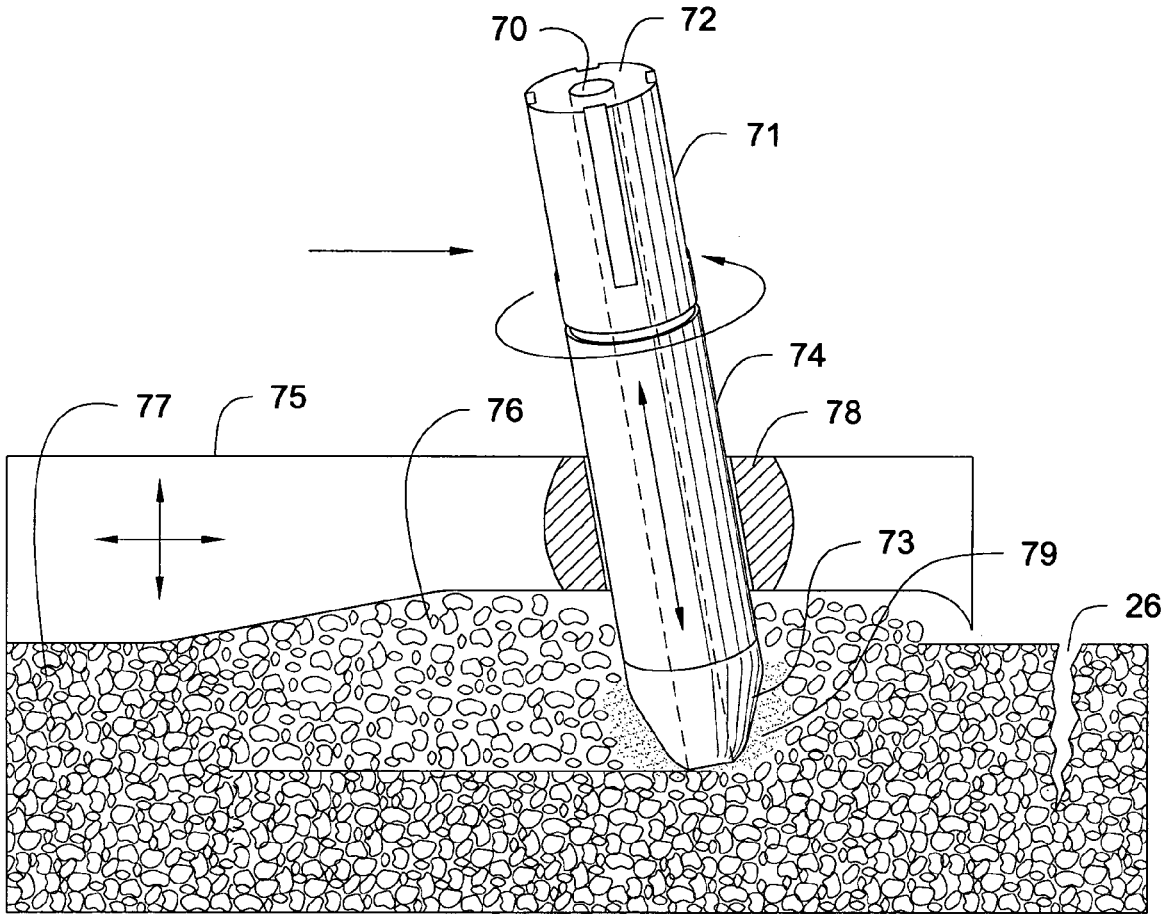
FIG. 6 is a diagram of a rotary tool and screed combination comprising a bearing mechanism providing for angular displacement.

In reference to FIG. 6, there is depicted a diagram of an embodiment of the rotary tool apparatus 71 being used in cooperation with a screed 75. The rotary tool 71 comprises an end 72 adapted for connection to a means for providing high-speed rotation and a working surface 73 similar to the rotary tools of the prior figs. Also the screed 75 features a concave working surface which promotes containment of the decomposed asphalt pavement 76 and aids in recompacting the asphalt surface into a finished surface 77. The rotary tool 71 further comprises an axial passageway 70 that may be in communication with a remote source of asphalt pavement renewal materials. The rotary tool 71 may also comprise additional passageways, as shown in the prior figs., for distribution of the asphalt renewals into the affected zone 79 adjacent the working surface 73 of the rotary tool 71. The screed further may comprise a bearing apparatus 78 adjacent a wear surface 75 of the rotary tool 71 which may allow the rotary tool 71 to attack the asphalt pavement at a rake angle. The rake angle may be positive or negative. The bearing apparatus 78 may further allow vertical displacement of the rotary tool during the remediation process.

Figure 7:
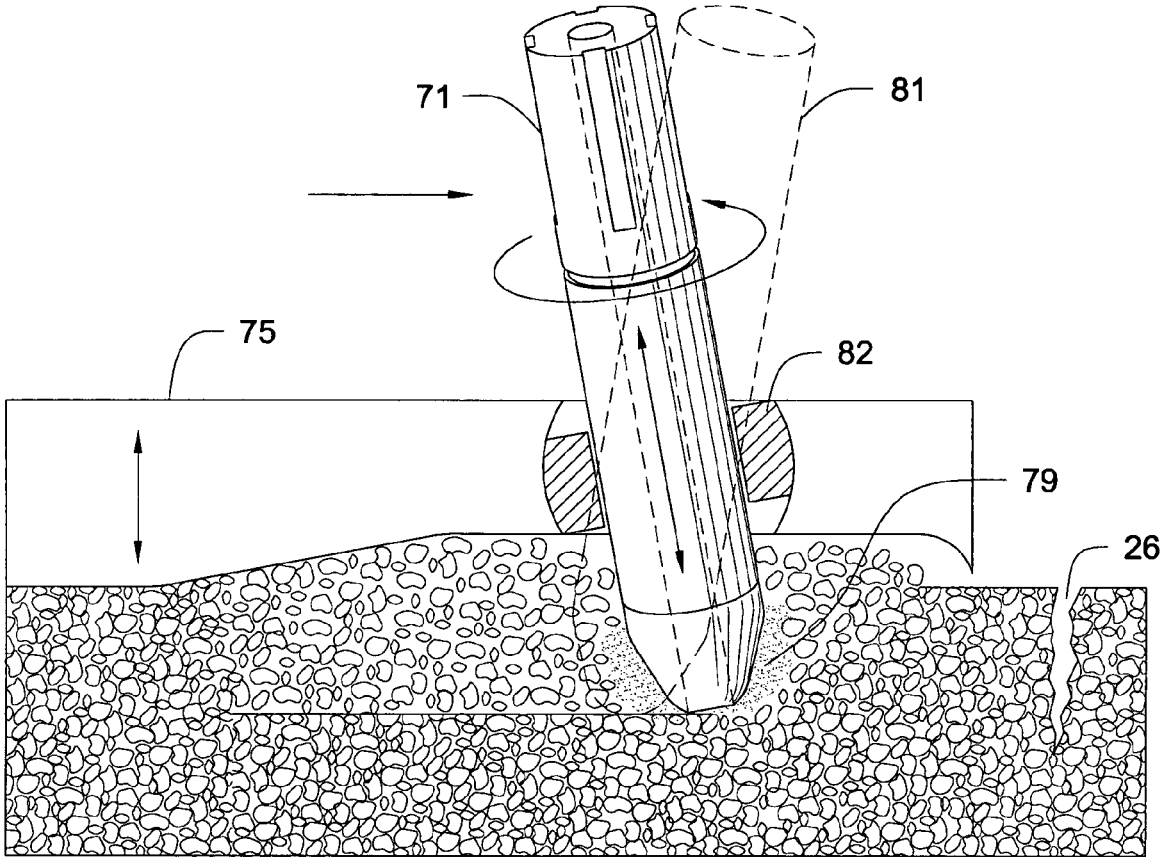
FIG. 7 is a diagram of a rotary tool and screed combination comprising a bearing providing precessional or oscillating movement of the tool.

A diagram of the rotary tool 71 and screed apparatus 75 of FIG. 6 are also presented in FIG. 7. The screed apparatus 75 of FIG. 7 further comprises a bearing apparatus 82 which may permit precessional and oscillating displacement 81 of the rotary tool 71, while at the same time the bearing apparatus 82 may provide a means for horizontal and vertical displacement of the rotary tool 71 and the screed apparatus 75.

Figure 8:
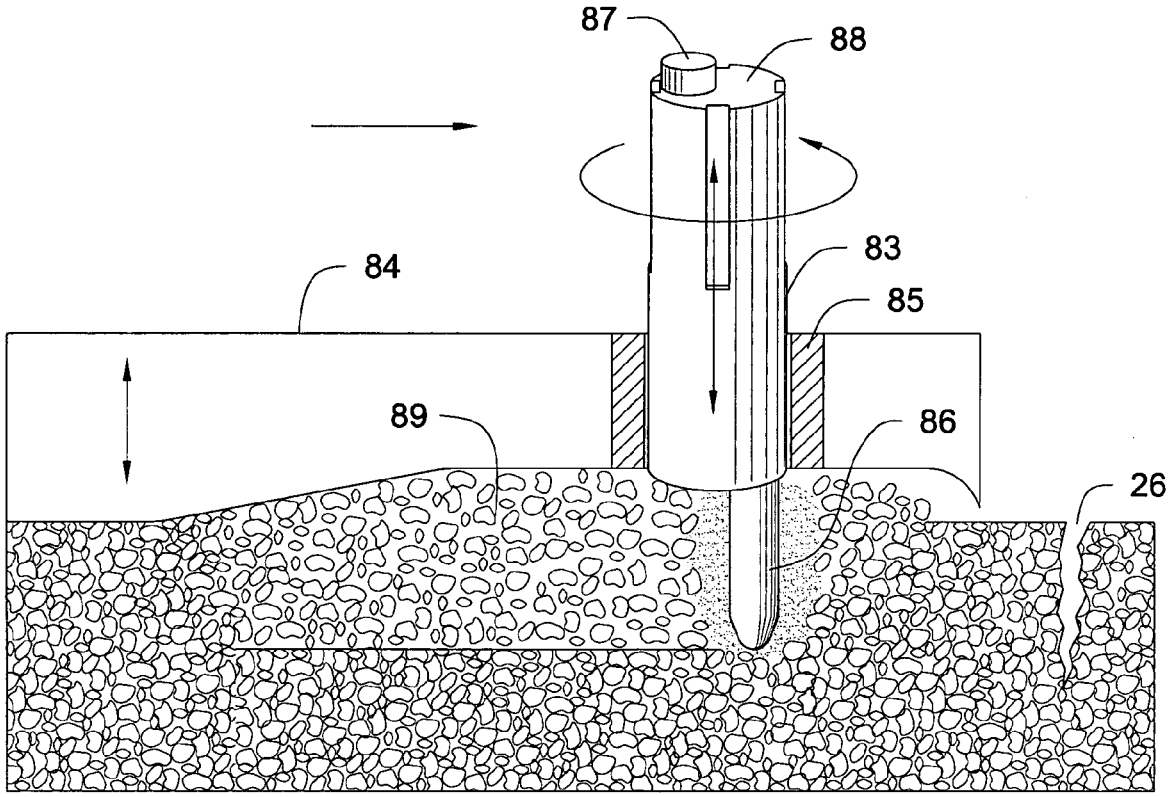
FIG. 8 is a diagram of a rotary of the present invention comprising an offset working surface.
Figure 9:
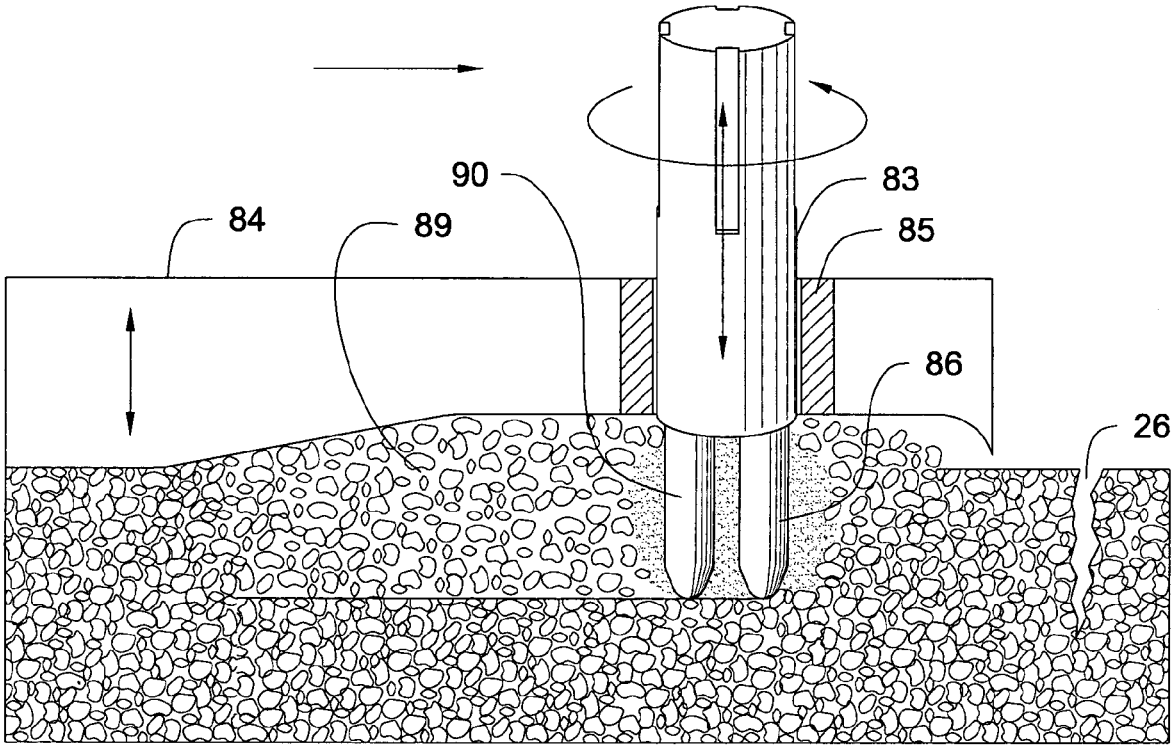
FIG. 9 is a diagram of a rotary tool comprising a double offset working surface.

FIG. 8 is a diagram of an embodiment of the present invention comprising a screed 84 working in cooperation with a rotary tool 83 for remediation of discontinuities 26 which may occur in asphalt paved surfaces. The screed 84 comprises a bearing apparatus 85 adjacent the rotary tool 83. As shown in other embodiments of the present invention, the bearing apparatus 85 may serve to orient rotary tool 83 at a rake angle and may allow for precessional displacement of the rotary tool 83 as it works the asphalt pavement. The rotary tool 83 comprises a working surface 86 that may be offset from the central axis of the rotary tool 83 and a counterbalance 87 on the opposite end 88 that may reduce the vibration that may be incident to the offset position of the working surface 86. Although not shown, rotary tool 83 may further comprise a means for attachment to a means for providing high-speed rotation as well as internal passageways for delivering asphalt renewal materials to the decomposed asphalt 89 as it is being worked by working surface 86. The offset working surface 86 may enhance the mixing action of rotary tool 83 and may provide for a more homogeneous mixture of asphalt renewal materials with the decomposed asphalt pavement 89. FIG. 9 is a diagram of an embodiment of the present invention comprising elements as depicted in FIG. 8 with the addition of a second working surface 90 opposed to working surface 86. The second working surface 90 may further provide stability to rotary tool 83 as well as providing more thorough mixing of renewal materials to the decomposed asphalt pavement 89.

Figure 10:
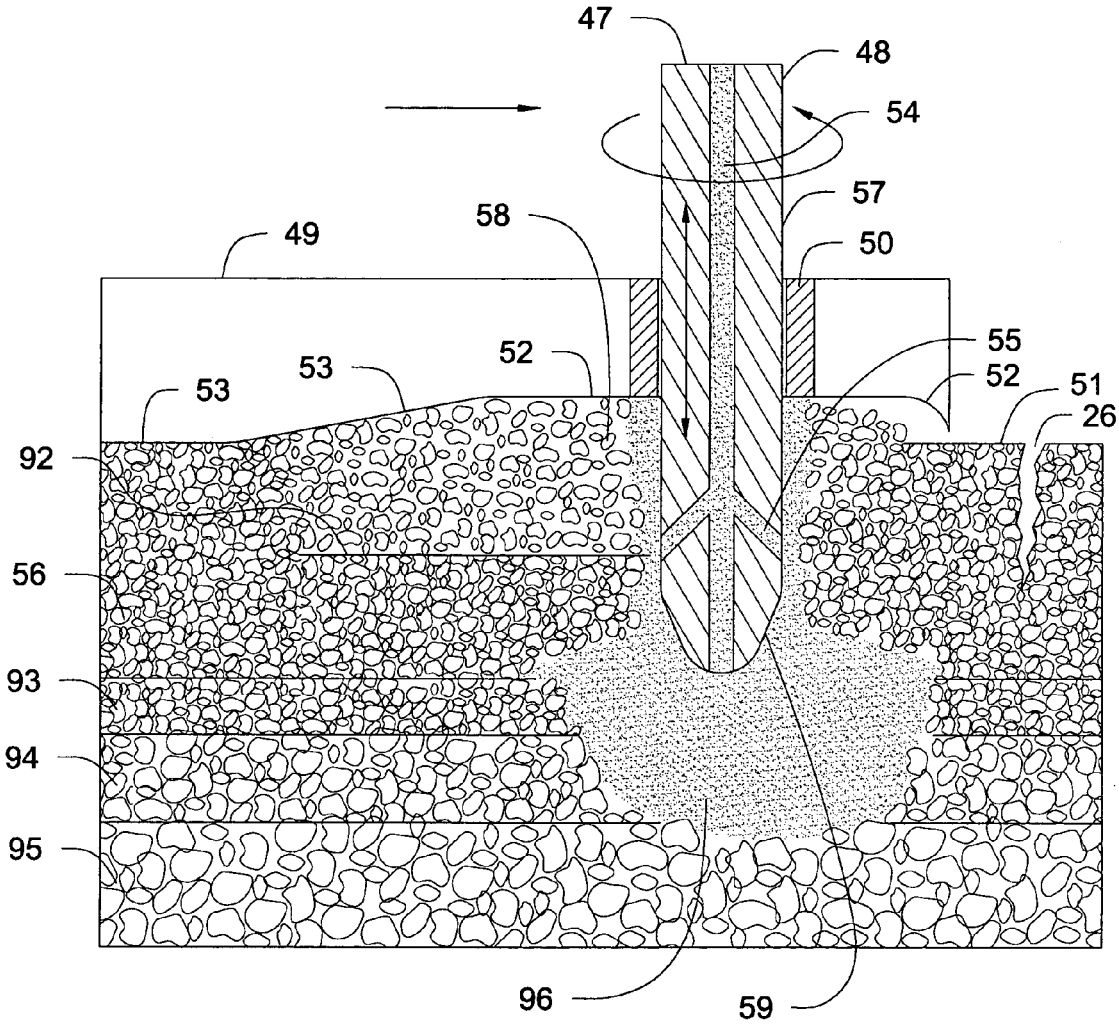
FIG. 10 is a diagram of a rotary tool remediating subsurface irregularities in the asphalt pavement.

FIG. 10 depicts the embodiment of FIG. 4 and illustrates further the manner in which the tool 48 may be used to remediate sub-surface irregularities 96 and voids 96 in the asphalt pavement. An asphalt paved surface may comprise one or more layers of base materials 93, 94, and 95. Base materials 93, 94, and 95, respectively, may comprise progressively smaller, or larger, composite materials such as rocks, gravel, and sand. A sub-surface irregularity may be caused by deficient installation of the base materials or the asphalt pavement. The condition may also result from earth movement, surface or sub-surface moisture, natural springs, leaking pipes, manholes, utility lines, animals, vegetation, flooding, freeze-thaw cycles, and excessive wear and heavy traffic. A sub-surface irregularity 96 may be sensed manually or by the tool's control system. Once the position of the sub-surface irregularity is ascertained, the rotary tool 48 may be directed from its normal elevation 92, either by the control system or manually, into the sub-surface irregularity 96. Renewal materials 54 may then be applied to the irregularity in order to renew the asphalt paved surface without having to remove the contiguous asphalt pavement. The tool 48 may then be returned to its normal elevation 92. The remediation of sub-surface irregularities may be accomplished in cooperation with remediation of the asphalt surface generally, or it may be accomplished selectively as required by the surface and sub-surface conditions.

Figure 11:
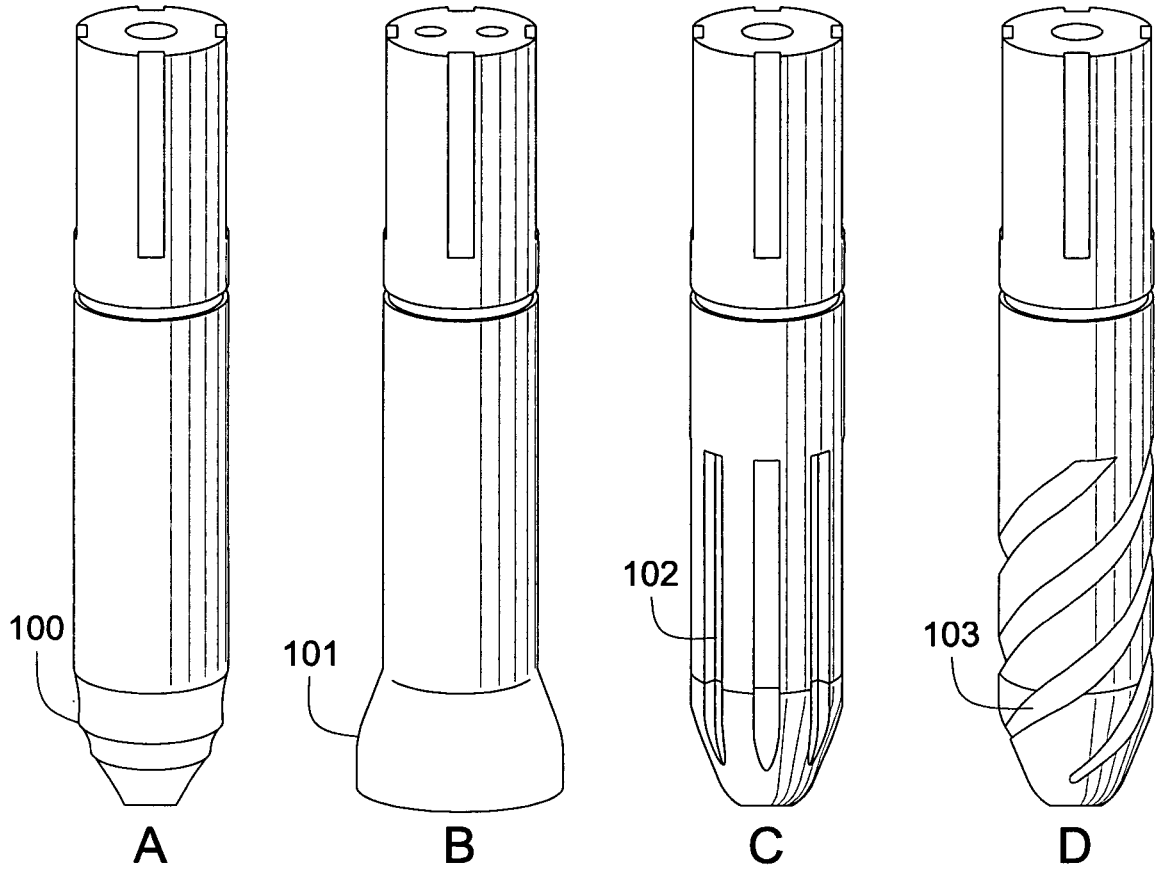
FIG. 11A through 11D are diagrams of rotary tools of the present invention comprising varying configurations of working surfaces.

FIG. 11 depicts rotary tools A-D of the present invention comprising alternate embodiments of their respective working surfaces. Rotary tool A comprises a working surface 100 comprising circular grooves; rotary tool B comprises a working surface 101 comprising a non-circular shape, such as an oval; rotary tool C comprises a working surface 102 comprising flutes; and rotary tool D comprises a working surface 103 comprising spiral grooves.

The rotary tool apparatus, and the rotary tool working in cooperation with a screed apparatus, may be controlled by a closed loop system that looks ahead of the asphalt paved surface being worked, reports on the conditions of the pavement coming up, and adjusts the operational parameters of the of the rotary tool and the screed in anticipation of the upcoming paved surface. Then, this process is repeated in order to work an extended section of asphalt paved surface without interruption. The closed loop control system may cooperate with operator manual controls, or preset controls, and operator inputs. The closed loop control system may comprise a rotary tool or a rotary tool working in cooperation with a screed. The closed loop control system may be in communication with sensors that report on the condition of the paved surface being worked and other sensors that report on the condition of the up coming pavement. Sensors and measurement devices that may aid in pavement remediation and form part of the closed loop control system are selected from the group consisting of tachometers, inclinometers, thermometers, strain gauges, load cells, position sensors, potentiometers, temposonics, encoders, accelerometers, thermometers, thermocouples, thermistors, and infra red temperature sensors. Such sensors may detect obstacles in the pavement such as curbs, gutters, manholes, utility boxes, depressions, voids, fissures, cracks, and crevices, and other discontinuities in the surface of the pavement. Furthermore, sonic sensors may detect subsurface discontinuities that eventually may lead to failure of the paved surface, itself. The rotary tool may be used to expose such subsurface defects and remediate the exposed defects with asphalt renewal materials in a manner similar to the remediation process for the asphalt pavement surface.

To further optimize the working of the asphalt pavement, the rotary tool and the screed may be in communication with a closed loop control system comprising computers, PLC systems, electromechanical systems, various sensors and linear measurement devices, and look ahead systems comprising direct contact, sonic, acoustic, infra red, nuclear resonance imaging, and magnetic resonance imaging to identify regions where hazards may exist and repairs may be required. The system may also identify conditions such as hazards, depressions, and variations in the pavement such as cracks, pot holes, manhole covers, rails, and other obstacles. The closed loop system may control the application of the rotary tool's and the screed's orientation to the pavement in anticipation of these conditions and obstacles, especially those that may be detrimental to the rotary tool. The closed loop system may avoid hazardous conditions by controlling the working depth of the rotary tool and screed, the load on the rotary tool and the screed, the angle of attack of the rotary tool and the screed when applied to the asphalt pavement, the rotary tool's speed of rotation, i.e. revolutions per minute or rpm, the addition of renewal materials, and the working temperature of the asphalt. Along paved surfaces where defects are sporadic, the closed loop control system may selectively apply the rotary tool and the screed only to regions and to depths of the asphalt pavement where repairs are required.

What is claimed:

1. An apparatus for working asphalt pavement, comprising: a means for providing high-speed rotation substantially normal to a surface of the asphalt pavement; a rotary tool positioned substantally normal to the paved surface and comprising a first end comprising a working surface and a second end adapted for connection to the means for providing high-speed rotation; wherein when the rotary tool is spun at high speed and applied to the asphalt pavement thereby locally heating the pavement to a temperature sufficient to soften an asphalt binder of the pavement adjacent the rotary tool; and the rotary tool is cooperatively arranged adjacent a screed, the screed comprising a working surface disposed adjacent the working surface of the rotary tool.

2. The apparatus of claim 1, wherein the rotary tool is cooperatively arranged adjacent a screed and the screed comprising a bearing mechanism permitting vertical displacement, horizontal displacement, angular displacement, or precessional displacement of the rotary tool, or a combination thereof, as the tool works the asphalt pavement.

3. The apparatus of claim 1, wherein the rotary tool comprises one or more passageways connecting at least a portion of the working surface of the rotary tool with a remote source of materials selected from the group consisting of asphalts, petrochemical binders, oils, tars, asphaltums, macadams, tarmacadams, tarmac, pitches, bitumens, minerals, rocks, pebbles, gravels, sands, and combinations thereof.

4. The apparatus of claim 1, wherein at least a portion of the first end of the rotary tool comprises a non-planar working surface selected from the group of shapes consisting of cones, spheres, hemispheres, flutes, grooves, and spirals, and combinations thereof.

5. The apparatus of claim 1, wherein the rotary tool is in communication with sensors and linear and angular measurement devices selected from the group consisting of one or more of tachometers, inclinometers, thermometers, strain gauges, load cells, position sensors, potentiometers, temposonics, encoders, accelerometers, thermometers, thermocouples, thermistors, and infra red temperature sensors.

6. The apparatus of claim 1, wherein at least a portion of the working surface of the screed comprises a convex surface.

7. The apparatus of claim 1, wherein at least a portion of the working surface of the screed comprises a concave surface.

8. The apparatus of claim 1, wherein the screed comprises one or more openings.

9. The apparatus of claim 1, wherein the screed comprises one or more openings each comprising a nozzle.

10. The apparatus of claim 1, wherein the screed comprises one or more openings in communication with a remote source of materials selected from the group consisting of one or both of asphalts, petrochemical binders, oils, tars, macadams, tarmacadams, tarmacs, pitches, bitumens, minerals, rocks, pebbles, gravels, and sands.

11. The apparatus of claim 1, wherein at least a portion of the working surface of the screed is inclined in relation to the rotary tool.

12. The apparatus of claim 1, wherein one or both of the screed and rotary tool comprises an abrasion resistant material selected from the group consisting of high-strength steel, metal alloys having a Brinell hardness in the range of 550 to 600, cemented metal carbides, polycrystalline diamond, CVD diamond, and cubic boron nitride.

13. The apparatus of claim 1, wherein the screed comprises a working surface at least a portion of which exhibits a coefficient of friction at least equal to or less than the working surface of the rotary tool.

14. The apparatus of claim 1, wherein the screed comprises a working surface at least a portion of which exhibits a substantially mirror-like polish.

15. The apparatus of claim 1 comprising a plurality of rotary tools cooperatively arranged for one or both of simultaneous and periodic application to the asphalt pavement.

* * * * *